United States Patent [19]

Ladt

[11] 4,444,129

[45] Apr. 24, 1984

[54] METHOD OF DRYING FINE COAL PARTICLES

[75] Inventor: Max A. Ladt, Paducah, Ky.

[73] Assignee: Lecorp, Paducah, Ky.

[21] Appl. No.: 439,629

[22] Filed: Nov. 5, 1982

[51] Int. Cl.[3] ..... F23D 1/00

[52] U.S. Cl. ..... 110/347; 110/204; 110/216; 110/245

[58] Field of Search ..... 110/245, 346, 224, 204, 110/216

[56] References Cited

U.S. PATENT DOCUMENTS

| | | | |
|---|---|---|---|
| 2,026,366 | 12/1935 | Stehli | 110/224 |
| 2,148,447 | 2/1939 | Dundas et al. | 110/224 |
| 3,190,627 | 6/1965 | Goins . | |
| 3,858,535 | 1/1975 | Shiba | 110/224 |
| 4,152,110 | 5/1979 | Jukkola et al. . | |
| 4,159,682 | 7/1979 | Fitch et al. | 110/216 |
| 4,168,670 | 9/1979 | Wall et al. | 110/245 |
| 4,174,946 | 11/1979 | Rohde . | |
| 4,213,407 | 7/1980 | Headley | 110/224 |
| 4,213,752 | 7/1980 | Seitzer . | |
| 4,242,972 | 1/1981 | Sicard | 110/216 |
| 4,245,395 | 1/1981 | Potter . | |
| 4,245,570 | 1/1981 | Williams | 110/204 |

*Primary Examiner*—Henry C. Yuen
*Attorney, Agent, or Firm*—King and Liles

[57] ABSTRACT

A method of drying wet coal fines smaller than 28 mesh in size employs both a vibrating fluidized bed type dryer and a coal fired burner for supplying hot drying gases to the dryer. A regenerative separator is interposed between the coal fired burner and the fluidized bed type dryer to satisfactorily remove particle matter from the gases without unacceptable pressure losses. Hot gases exhausted from the fluidized bed type dryer are also cleansed to remove particulate coal particles which are used as fuel for the coal fired burner.

4 Claims, 2 Drawing Figures

METHOD OF DRYING FINE COAL PARTICLES

BACKGROUND OF THE INVENTION

The invention relates generally to coal drying and more specifically relates to a method of drying wet coal fines smaller than 28 mesh in size. The invention will be specifically described in connection with a method of drying the coal fines in a fluid bed type dryer heated with a coal fired burner fueled with ultrafine coal particles carried away from the fluidized bed with the exhaust gases.

In the processing of coal, it is highly desirable, and often mandatory, to remove a number of impurities from the coal prior to use. The need to remove these impurities has increased in recent years with the advent of modern mining techniques. Although these modern mining techniques are highly efficient and permit high production rates, they tend to be less discriminating than older mining techniques in the collection of material from the ground. As a result, coal mined by many of these modern techniques tends to have an even greater amount of impurities than was common several years ago. As a result, the need to process coal through a cleaning process to remove impurities has been accentuated in recent years.

There are a number of processes for removing impurities from coal. In general, these are washing type processes which leave the coal wet. It is then necessary to remove moisture from the cleaned coal through a thermal dryer or the like.

One approach to drying coal fines after an initial washing process is to pass the wet coal through a vibrating fluidized bed dryer where hot gases are forced through an orifice plate to fluidize a bed of coal to be dried on top of the plate. Other dryers in these systems use oil or gas burners to supply hot gases to the dryer, which result in poor economics, especially if the coal has high ash or sulphur content or is otherwise of low quality.

Modern mining and cleaning techniques also result in more fine material or coal fines. The coal fines have a greater surface area than larger pieces of coal and therefore have a greater capacity for retaining moisture. Not only does this fine material have a greater water retention capacity, the individual particles have a tendency to adhere to each other forming agglomerations. Consequently, the wet fines have presented considerable handling and drying problems. In the past, when coal fines were being processed, the attendant drying and handling complications usually necessitated mixing in coarser material before use of fluidized bed dryers. Users were thus relegated to using machines of much greater capacity for drying these wetted coal fines. The wetted coal fines, having a consistency very similar to wet clay and would, for example, clog up the orifices in a fluidized bed plate, disrupting the dryer's operation.

As noted above, other vibrating fluidized bed dryers in the past have used relatively expensive oil or gas heat to supply gases for drying. The reason is that coal burners inherently generate fly ash and this fly ash tends to clog up the orifices of a fluidized bed type dryer from the underside of the plate. As a result, the most economic burner for coal drying systems has not been heretofore technically feasible.

SUMMARY OF THE INVENTION

Accordingly, it is a primary object of the present invention to provide a method and apparatus for economically drying coal fines smaller than 28 mesh in size.

It is a further object of the present invention to provide a method and apparatus wherein a coal fueled burner may be used to supply heat for drying coal fines.

Additional objects, advantages, and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

The above and other objects of the invention are met by the present invention which provides a method for fueling a burner with coal and using gases heated by that burner to dry coal passing through a fluidized bed type dryer without clogging the dryer during the process. The invention provides for passing gases heated by the coal fueled burner through a regenerative separator to remove particulate matter therefrom. The regenerative separator efficiently removes particulate matter from the gases without significant pressure drops so as to allow effective utilization of both a coal fueled burner and a fluidized bed type dryer.

The invention has the additional advantages of utilizing collected particulate coal entrained in dryer exhaust gas as a fuel for the burner. At least a portion of the gases directed through the fluidized bed dryer are passed through a filter where ultrafine particulate coal particles are collected and supplied as fuel for the burner. When operating according to the preferred method of the invention, this collected ultrafine coal material may be used as a burner fuel without additional processing.

The invention further provides for mixing of gases heated by the coal fueled burner with gases exhausted from the dryer prior to filtering the combined gases in the regenerative separator. Recycling and mixing of the gases reduces the enviromental cleaning demands on the system and provides a relatively inert medium from the heater to prevent combustion of the coal in the dryer.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the following preferred embodiment of the invention, an example of which is illustrated in the accompanying drawings.

BEST MODE OF CARRYING OUT THE INVENTION

Figure 1:
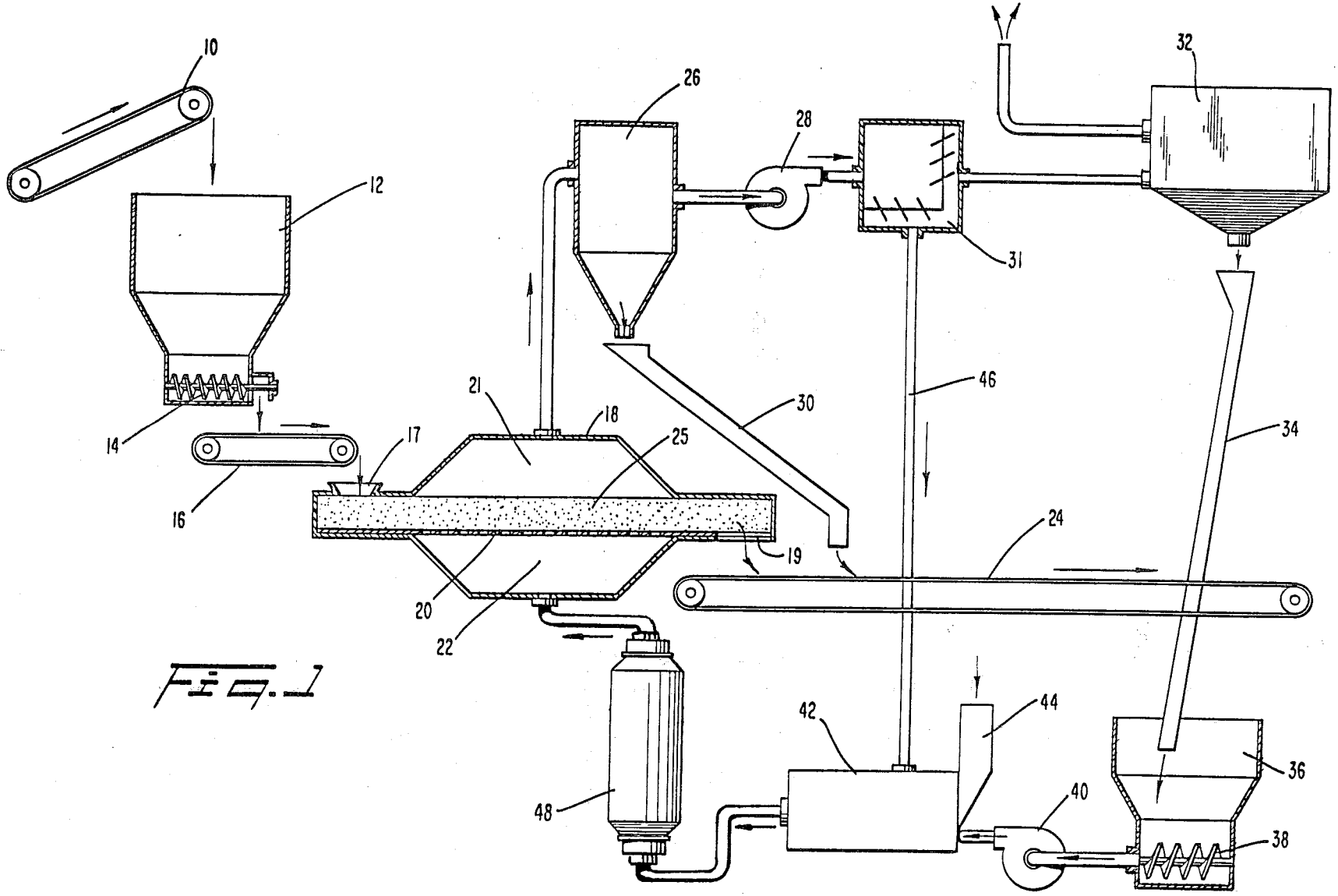
FIG. 1 is a schematic diagram of a fine coal drying system illustrating the flow of material and gases of the preferred embodiment of the invention.

Reference is now made to FIG. 1 showing a diagramatic flow chart of an improved process for drying coal fines. A drying system arranged according to the flow chart has been found to be particularly advantageous in the drying of fine coal particles smaller than 28 mesh in size. In FIG. 1, wet coal fines are supplied from a washing process and transported on a continuously moving transport conveyor 10 for deposit into the top of a live bottom surge hopper 12.

The entire bottom portion of this surge hopper 12 is a variable rate screw type volumetric feeder 14 to controllably deliver coal from the surge hopper 12 to a dryer feed 16. The feeder 14 includes a series of feed screws discharging to a common screw feeds material at a controlled rate and is driven by DC motor and an SCR controller.

The dryer feed 16 further transports the coal into an inlet 17 of a vibrating type fluid bed dryer 18. The dryer 18 includes a perforated bed deck 20 separating a fluidized chamber 21 from a subjacent hot air plenum 22. The top side of the perforated deck 20 supports a bed 25 of fine, wet coal particles, none of which is larger than 28 mesh in size. The wet coal particles, which typically would contain more than 20 percent moisture, is fluidized in the chamber 21 as that coal material migrates from the dryer inlet 17 to a dryer outlet 19 under the inpetus of vibratory movement applied to the dryer in a well known conventional manner.

The bed 25 of fine coal material supported upon the perforated deck 20 within the fluidized chamber 21 is fluidized by hot pressurized gas introduced into the plenum 22 and passed through the perforations in the deck 20 into the fluidized chamber 21. These hot gases tend to fluidize the bed 25 in a bubbling type action to throw about and dry the individual coal particles.

As noted above, the preferred embodiment of the invention is designed to handle and dry very fine coal particles smaller than 28 mesh in size. Applicant has found that handling and drying of such fine coal particles is greatly facilitated to the use of a drilled deck 20 in the fluidized dryer with a plurality of drilled holes equally spaced in a grid arrangement. A drilled deck of this type permits evenly distributed air flow through an open area that is small relative to the overall area of the deck 20. Hot gases are introduced into the plenum 22 at pressure. These pressurized gases are accelerated as they pass through the drilled orifices of the deck 20 and the pressure is converted to velocity head. The high velocity gases then pass through the bed 25 of coal on the deck 20 throwing about individual particles to fluidize the bed 25. In the preferred process, the pressure drop across the deck 20 and through the bed 25 is between 3 and 5 inches of water, most preferably approximately 5 inches of water.

The gases passing through the dryer 18, preferrably are fixed at a superficial velocity calculated to carry off only extremely small particles of approximately 200 mesh in size and are maintained at approximately 500° F. or above. These hot gases thus serve to dry the fluidized coal particles in the bed 25 as that bed of material migrates through the dryer for discharge at outlet 19 onto an outlet conveyor 24.

Hot gases passing through the bed 25 are passed through the top of dryer 18 and directed into a dust collector 26 for preliminary cleaning. Removing particulate matter from the gas as expelled from the dryer 18 is not absolutely necessary at this location for successful operation of the drying system. However, the use of a dust collector at the location where gas is exhausted from the dryer 18 is advantageous in that it allows use of a more efficient blower design which reduces the horsepower requirements of a blower 28 positioned downstream of the collector 26. Virtually any type of collector 26 will probably work at this location to preliminarily cleanse the air from the dryer 18, but use if made of another regenerative separator because of its efficiency. As shown in the drawing, coal dust removed from the collector 26 may be fed back to the outlet conveyor 24 through a chute 30 having an air lock sealingly tied into the outlet conveyor 24.

As suggested above, exhaust gases passing through the dust collector 26 are directed into a blower 28. The blower 28 forces the partially cleansed gases into a series of control dampers 30 which proportion the exhaust gases into two separate routes.

A first portion of the exhaust gases are directed to a baghouse 32 where they are passed through a series of cloth fabric filters for removal of particulate coal particles. These coal particles are collected and periodically dispelled, by way of a pulsing air system, through a chute 34 into a burner feed hopper 36. The gases passed through the fabric bags of baghouse 32 are released into the atmosphere either directly, or through further cleaning apparatus such as a scrubber. The proportion of gas discharged in only that amount required to discharge water at a rate equal to the water taken out of the coal.

Significantly, the coal particles collected in the baghouse 32 and fed back into the burner feed hopper 36 provide a fuel which may be used for a burner to heat gases supplied to the dryer 18. Furthermore, due to the design of the system, only small particles are removed from the dryer bed and collected in the fabric of baghouse 32. Consequently, no fuel preparation is needed for the coal particles deposited into the burner feed hopper 36 and the particulate material that has been removed from the gases can be fed directly into a burner 42 as fuel.

The burner feed hopper 36, has a variable rate volumetric bin burner feeder 38 in its lower portion for feeding the fine coal particles from the burner hopper 36 to an injection blower 40. The injection blower 40 injects the fine coal particles into a coal burner 42 where the coal is mixed with combustion air drawn from the ambient atmosphere through an inlet 44 and ignited. The amount of combustion air drawn through the inlet 44 is preferably limited to that amount necessary to satisfy complete combustion of the coal fed to the burner 42 from injection blower 40.

A second portion of the exhaust gases entering the control dampers 30 is recycled through a conduit 46 and mixed with the combustion products in burner 42 immediately downstream of the flame area. Such mixing of gases in the burner will reduce the temperatures of the combined gases to a satisfactory level, which in applicant's preferred method is approximately 600° F. to 800° F. The exhaust gas is relatively inert and thus minimizes the possibility of further combustion of any particles in the hot gases downstream of the burner 42. Further, recycling of the exhaust gases reduces the amount of gas being released to the atmosphere and correspondingly reduces gas cleanup and environmental concerns and equipment costs.

As noted above, it was previously believed that coal fired burners could not efficiently be used to heat gases supplied to a vibrating fluidized bed type dryer, particularly when the coal product to be dried was coal fines of the type to which applicant's process is directed. Applicant has discovered that a coal burner can be used in such an environment if a regenerative separator 48 is interposed in the gas flow path between the burner 42 and dryer 22. A regenerative separator, unlike other types of dust collectors which will not satisfactorily operate at this location, will effectively remove particles from the gas stream without unsatisfactorily dropping the pressure.

Figure 2:
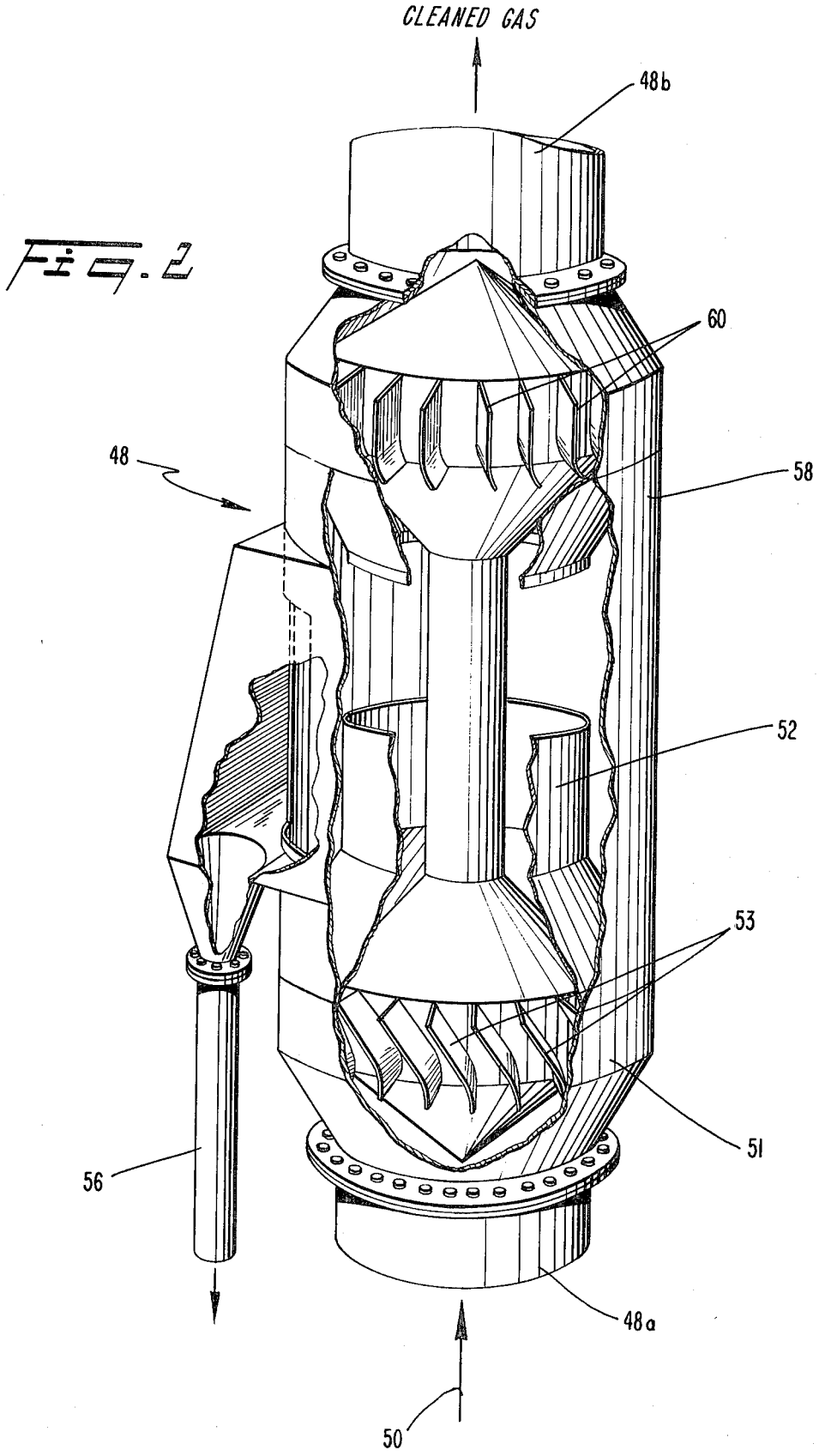
FIG. 2 is a fragmentary perspective view of a regenerative separator disposed between the coal fueled burner in fluidized bed type dryer of the preferred embodiment depicted in FIG. 1 illustrating the general operational principles of a regenerative separator.

A regenerative separator separates particulate matter from the gases through a process of accelerating and deaccelerating the gases as they are rotated in the separator. A form of regenerative separator 48, preferably used in the system of FIG. 1, is depicted in FIG. 2. Gas from the coal fired burner 42 is directed into an inlet end 48*a* of the separator 48 as represented by arrow 50. The gases entering at this location are filled with fly ash from the burner 42 and directed through a series of blades 53 within an annular passage 51 of the separator 42. The blades 53 import a rotational movement to the gas 55. The rotating gas stream is passed from this annular passageway 51 to a second annular passageway 52 of reduced diameter. As predicted by the law of conservation of annular momentum, there is an acceleration of the gases to a higher rotational velocity with a corresponding drop in pressure. In this high velocity annular chamber 52, the particulate coal particles in the gas stream are thrown centrifugally outwardly and collected in a chute 56 for discharge as waste material. The rotating gas is then passed to a larger annular passageway 58 for deacceleration. The deaccelerated gases are then divided through a series of outlet blades 60 to completely stop rotation of the now cleaned gas and discharged through an outlet 48*b*. The gas discharged from the outlet end 48*b* is then directed into the plenum 22 of the dryer 18 for drying of the fine coal material. The interposition of such a regenerative separator between the burner 43 and the dryer 18 enables the use of both a vibrating fluidized bed type dryer and a coal fired burner, neither of which have previously been employed successfully in the drying of fine coal particles.

In summary, numerous benefits have been described which result from employing the concepts of the invention. The invention permits efficient drying of fine coal particles smaller than 28 mesh in size in a fluidized bed type dryer. Moreover, the fluidized bed type dryer made in accordance with the invention may be heated by a coal fired burner. A regenerative separator is interposed between the burner and the dryer to remove sufficient particulate matter from the gases supplied to the dryer to prevent clogging of a drill type deck bed in the dryer. The utilization of the regenerative separator makes the use of a coal fuel burner possible in the system. Fine coal material exhausted from the dryer is collected and supplied to the coal burner as a fuel without the necessity of further fuel preparation.

The following description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention and various embodiments and with various modifications as are suited to the particular use contemplated. It is intended that the scope of the invention be defined by the claims appended hereto.

I claim:

1. A method of drying fine coal particles smaller than approximately 28 mesh in size, comprising the steps of:

(a) heating gases with a coal fueled burner;

(b) passing the gases heated by the burner through a regenerative separator to remove substantially all particulate ash particles therefrom to prevent ignition of the coal particles;

(c) passing coal particles to be dried from an inlet to an outlet of a fluidized bed type dryer;

(d) directing the gases from the regenerative separator through the fluidized bed dryer to dry the coal particles as they are passed therethrough;

(e) collecting dried coal particles for future use as fuel;

(f) recirculating the bulk of the gases to the burner prior to passing the gases through the regenerative separator, gases not recirculated being limited to that amount required to discharge water equivalent to that removed from the coal stream to be dried; and (g) the step of passing the heated gases through the regenerative separator including the steps of providing rotational movement to the gases by intersecting curved blades positioned in the path of the heated gases, and removing the ash particles during the rotation of the gases through the side of the separator.

2. A method of drying fine coal particles as recited in claim 1 further including the steps of filtering at least a portion of the gases directed through the fluidized bed dryer to collect particulate coal exhausted from the dryer and utilizing the collected particulate coal to fuel the coal fueled burner.

3. A method of drying fine coal particles as recited in claim 1 further including the step of collecting at least some of the coal particles from gas exhausted from the dryer for mixing with dry coal paths delivered through the outlet of the dryer.

4. A method of drying fine coal particles as recited in claim 1 including the additional step of stopping the rotational movement of the gases in the regenerative separator before entry into the fluidized bed dryer, by intersecting blades curved in the opposite direction from the rotation.

* * * * *